United States Patent [19]

Fahrbach

[11] Patent Number: 4,469,285

[45] Date of Patent: Sep. 4, 1984

[54] COIL WINDING MACHINE WITH MULTI-AXIS POSITIONING FOR WINDING TELEVISION DEFLECTION COILS

[75] Inventor: Rudolf Fahrbach, Branchville, N.J.

[73] Assignee: Universal Manufacturing Co., Inc., Irvington, N.J.

[21] Appl. No.: 413,672

[22] Filed: Sep. 1, 1982

[51] Int. Cl.[3] ..... H01F 41/06; H01F 41/08; B65H 81/00

[52] U.S. Cl. ..... 242/7.14; 140/92.1; 242/4 R

[58] Field of Search ..... 242/4 C, 4 R, 4 BE, 242/4 B, 7.05 B, 2, 3, 7.14, 82; 140/92.1

[56] References Cited

U.S. PATENT DOCUMENTS

| | | | |
|---|---|---|---|
| 2,901,190 | 8/1959 | Wentz | 242/2 |
| 3,128,056 | 4/1964 | Fahrbach | 242/7.14 |
| 4,007,881 | 2/1977 | Haslau et al. | 242/4 C |
| 4,373,680 | 2/1983 | Polge | 242/7.14 |

*Primary Examiner*—Billy S. Taylor
*Attorney, Agent, or Firm*—Eliot S. Gerber

[57] ABSTRACT

A coil winding machine winds a wire about a core to form, for example, one-half of a television deflection coil. The wire is spun about the core by a flyer arm which is rotated about an axis and guides the wire over a series of pulleys rotatably mounted thereon. The wire is pulled through the bore of a tubular shaft, which carries the flyer arm, which shaft is driven rotatably and reciprocally along its axis. The core is removably held in a clamp which is fixed to a tool holder having gear teeth, preferably a sector of a worm gear. The tool holder is driven to obtain a rocking motion during the winding operation by a worm mounted on a drive shaft. That drive shaft is rotatably held in the cross-member of a cradle assembly which cradle assembly is pivotally mounted on the base and rocked back and forth during the winding operation.

6 Claims, 8 Drawing Figures

COIL WINDING MACHINE WITH MULTI-AXIS POSITIONING FOR WINDING TELEVISION DEFLECTION COILS

BACKGROUND OF THE INVENTION

The present invention relates to coil winding machines and more particularly to a coil winding machine for winding cores which are sectors of television toroidal deflection coils.

The inventor's prior U.S. Pat. No. 3,128,056 is entitled "Machine For Winding Toroidal Television Vertical Deflection Coils" and is incorporated by reference herein. It describes a coil winding machine in which a core, for example, one-half of a toroidal core, is removably held in a clamp (tool holder). A flyer arm spins and carries a wire around the core. The position of the core is changed, relative to the flyer arm, by swinging a cradle which carries the clamp holding the core. That machine may lay the wire in parallel superimposed rows.

That core winding machine permitted the spacing between the wires to be changed from one batch of cores to another, by changing the speed at which the cradle was swung. However, the control over the cradle was such that its movement was uniform in speed while winding a core. The movement of the core was limited to rotation about the pivot mounting of the cradle, so that the wires were laid in parallel and not at an angle to each other.

The design of toroidal coils, and particularly television deflection coils, changes with new demands. It is now desired that the cores be wound in more complicated ways. For example, the desired pattern may be that the wires are parallel in one sector, angled at increasing angles in another sector, close together in a third sector and angled in a reverse direction and further spaced apart in a fourth sector. Such a complicated coil can be wound by hand, but its cost would be prohibitive.

OBJECTIVES AND FEATURES OF THE INVENTION

It is an objective of the present invention to provide a coil winding machine to wind the cores of television deflection coils and similar coils at a high rate of speed and with the possibility of laying the wires in a complex pattern on the core.

It is a further objective of the present invention to provide such a coil winding machine in which each core may be wound with a different pattern of wires.

It is a further objective of the present invention to provide such a coil winding machine in which the wires may be laid automatically in any desired pattern on the core, including parallel, angled at the same angle, and angled at different angles.

It is a further objective of the present invention to provide such a coil winding machine in which the control over the laying of the wires may be completely automatic and without operator intervention.

It is a feature of the present invention to provide a coil winding machine for winding wire on a core to form a coil. For example, the core may be one-half of a toroidal television deflection coil. The coil winding machine includes a base, with the other portions of the machine mounted thereon. The machine includes a flyer arm means which is revolvable about its imaginary axis and carries the wire to wind it upon the core and means to rotate the flyer arm about its axis. Preferably the flyer arm means comprises a flyer arm, a series of wire pulleys rotatably mounted on said flyer arm to carry the wire, and a tubular shaft connected to the flyer arm through which said wire is pulled. The tubular shaft has an exterior wall which is round partly along its length and splined partly along its length. Bushings, mounted on the base, rotatably hold the round portions and a splined pulley is in driving contact with the splined portion. The coil winding machine also includes means to move the flyer arm back and forth in the direction of its axis.

The core is removably held by clamp means which is connected to tool holder means. The tool holder means is rocked back and forth by rocking means which rocks it about an axis to vary the position of the core relative to said flyer arm. The tool holder means is pivotally mounted on cradle means which is pivotally mounted on the base. The machine has means to rock the cradle means back and forth about its pivot mount.

Preferably the tool holder means includes a worm gear fixed, for example, on its bottom face. The means to rock the tool holder means includes a worm rotatably mounted in the cradle means, with the worm meshing with and driving the worm gear.

BRIEF DESCRIPTION OF THE DRAWINGS

Other objectives and features of the present invention will be apparent from the following detailed description of the inventor's preferred embodiment which provides the inventor's presently known best mode of practicing the invention. The detailed description should be taken in conjunction with the accompanying drawings, in which.

DETAILED DESCRIPTION OF THE INVENTION

Figure 1:
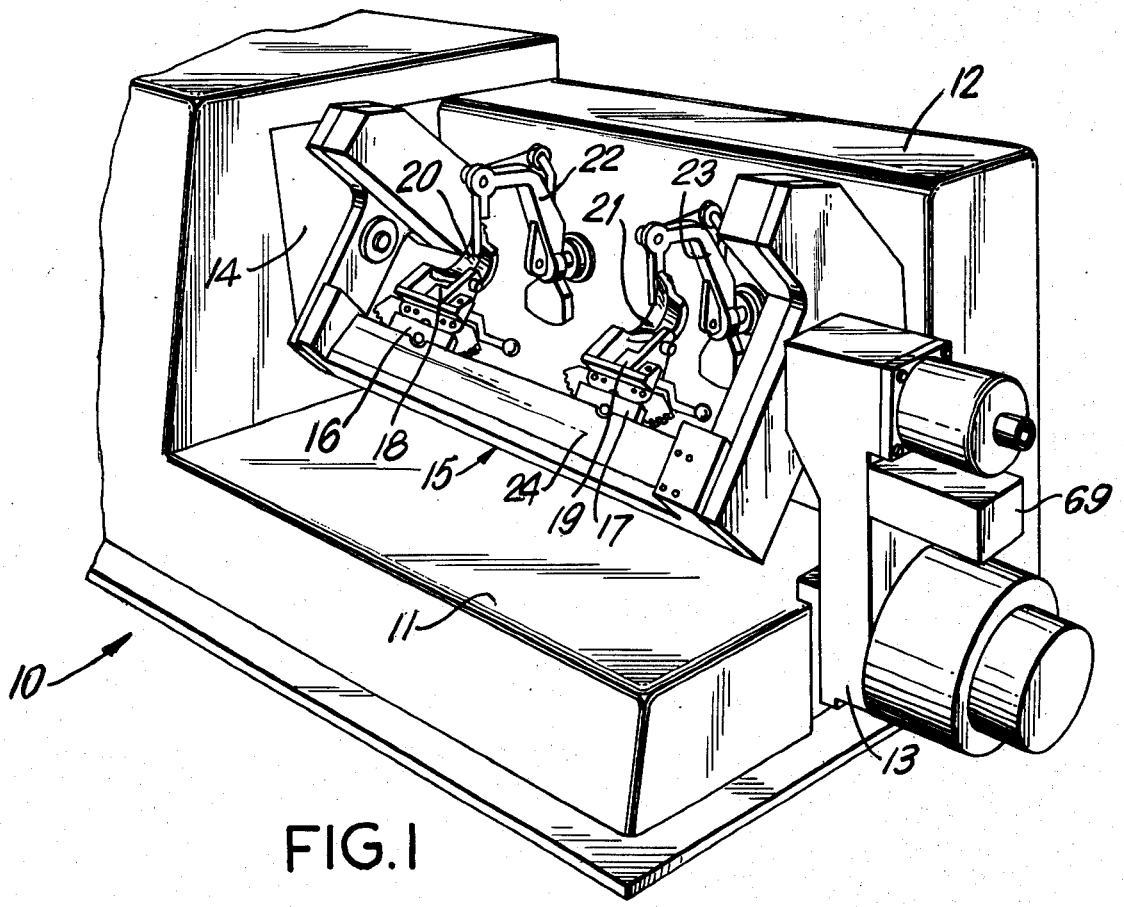
FIG. 1 is a perspective simplified view of the coil winding machine of the present invention.

As shown in FIG. 1, the winding machine of the present invention includes a base 10 having a platform portion 11 and a raised back portion 12.

Two opposed vertical upright members 13,14 are mounted on the base. The upright members 13,14 support a swingable cradle assembly 15 between them. Two movable tool holders 16,17 are positioned on the cross-member 24 of the cradle assembly 15. A clamp 18,19 is mounted on each of the respective tool holders 16,17. A core 20,21 is removably held in each of the respective clamps 18,19.

A pair of winding arms 22,23 are rotatably and slidably mounted on back portion 12. The winding arm 22 winds a wire about the core 20 while it is held in the clamp 18. Simultaneously, the winding arm 23 winds a wire about the core 21 held in the clamp 19.

Figure 2:
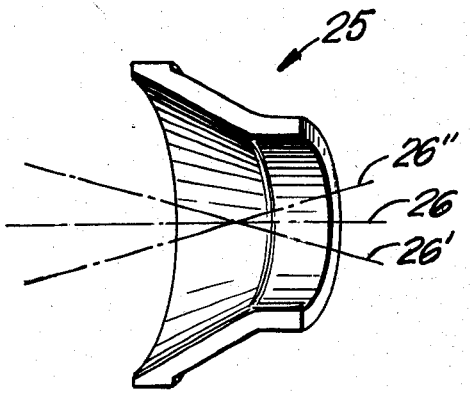
FIG. 2 is a perspective view showing one type of core which may be wound by the coil winding machine of the present invention.

A typical core 25 wound by the coil winding machine of the present invention would be a sector of a toroidal core, as shown in FIG. 2.

The core 25 has an imaginary axis 26. The wire, when wound about the core, may be parallel to the axis 26 or at an angle to that axis. The wire is wound on the core 25 by being pulled around the core as it is played off from a flyer arm 22,23. The flyer arm rotates about its axis and also may be driven back and forth along its axis. The tool holders 16,17 may be driven to rock back and forth, tilting the axis 26 to the positions 26 and 26''. The cradle assembly 15 may be driven so it also swings, causing the core to rotate about its axis 26, since preferably the axis 26 is the same centerline as the cradle assembly 15.

Figure 3:
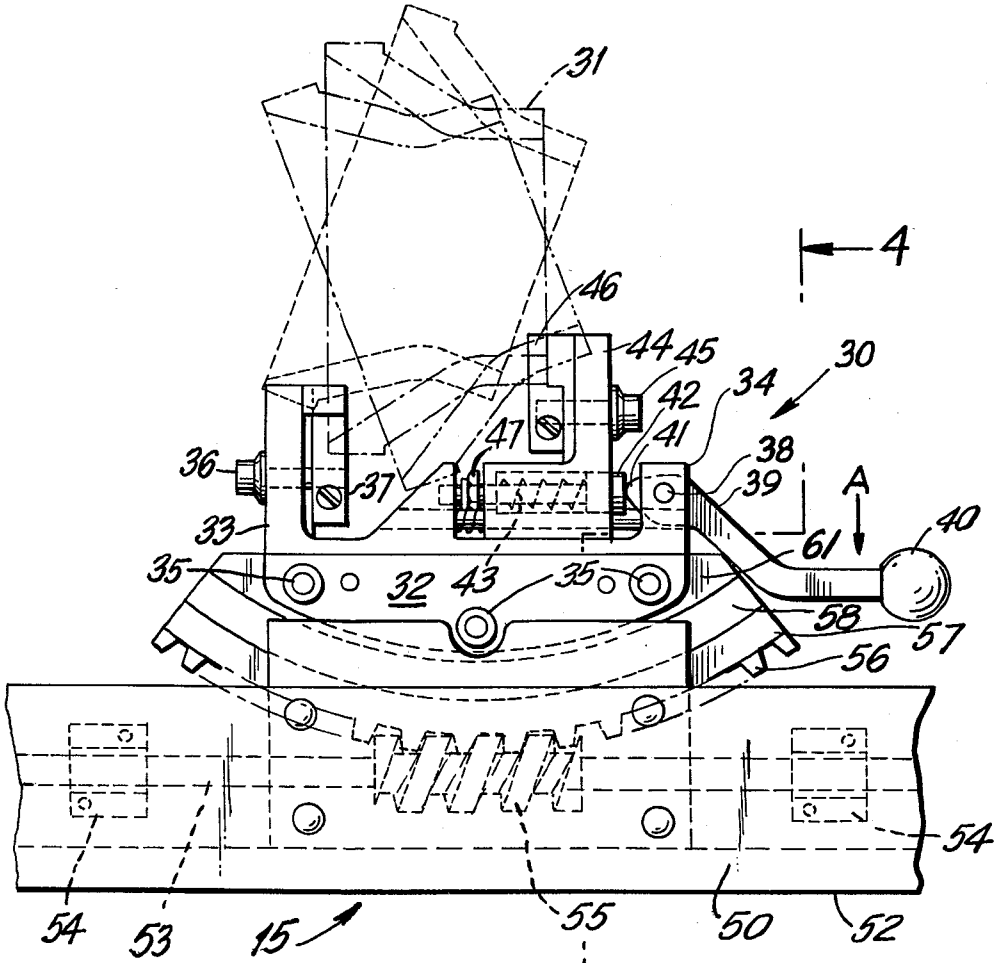
FIG. 3 is a front plan view of the clamp and arbor.

The clamp 30 which holds the core 31 is shown in FIG. 3. In the illustrated embodiment the core 31 is one-half, i.e., a 180° sector, of a television deflection coil. When the two sector cores are joined together, after being wound, they form a complete toroidal coil.

The clamp, as seen in the side view of FIG. 3, has a wide base portion 32 and two opposite raised end portions 33,34. The base portion 32 has a series of holes 35 which are used to bolt the base portion 32 onto the tool holder. The raised end portion 33 is bolted by bolt 36 to a fixture 37 which holds the core 31, the core being shown in dash-dot lines. The first fixture 37 may be changed depending upon the size and shape of the core which is being wound.

The opposite raised end portion 34 has a pivot 38 which pivotally mounts a lever arm 39. The lever arm 39 has a handle 40 at its outer end and a cam face 41 at its inner end. The cam face 41 acts upon the boss which is integral with the movable clamp arm 44 which is spring-loaded by spring 43. The spring 43 acts between the stop 47 and the inside face of the boss 42. A bolt 45 removably connects the second fixture 46 to the movable clamp arm 44. The core 31 is held between the fixture 37 (which is fixed) and the fixture 46 (which is movable). When the lever arm 39 is lowered, in the direction of arrow A, about its pivot 38 the cam face 41 causes the movable clamp arm 44 to move to the left and thereby tightens the movable fixture 46 to the core. The fixed end portion 33 and the movable clamp arm 44 have inwardly inclined sides to form an inverted "V" in end view, see FIG. 4. This permits the flyer arm to pass close to the core.

The tool holder assembly is also shown in FIG. 3. The cross-member 50 of the cradle assembly 15 includes an elongated L-shaped (in cross-section) support member 52 within which the shaft 53 rotates. A set of bushings 54 are fixed relative to the support member 52 and permit rotary motion of the shaft 53 within the bushings 54. A worm 55 is fixedly mounted on the shaft 53 so that the worm 55 rotates when the shaft 53 is rotated. The worm 55 meshes with a worm gear 56 which is attached to (or integral with) the tool holder 57. The bottom face of the tool holder 57, which is the face having the worm gear teeth, is curved so that the tool holder 57 is sector-shaped, in plan view, as seen in FIG. 3. The curvature of the worm gear 56 is a sector of an imaginary circle and may, for example, be 60° of that circle.

Figure 4:
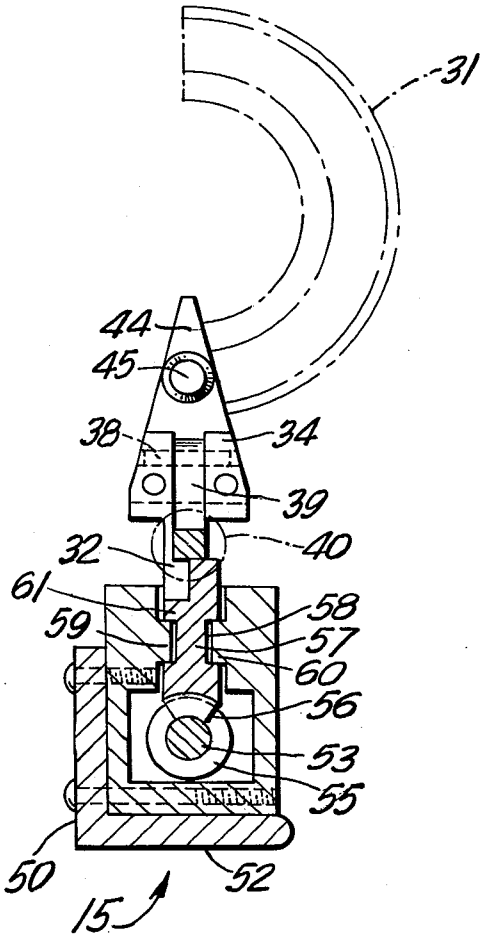
FIG. 4 is a sectional view taken along lines 4—4 of FIG. 3 in the direction of the arrows.

The tool holder 57 has a flat portion 58 which is flat on its opposite sides. As seen in FIG. 3, the curvature of the bearing portion 58 is taken from the same center as the curvature of the worm gear 56. The opposite flat sides of bearing portion 58, as shown in FIG. 4, slidingly fit between the inwardly protruding arms 59 and 60 which are fixed to the support member 52. The tool holder also has a flat raised portion 61 which holds the clamp 30 which releasably mounts the core onto the arbor assembly.

Figure 6:
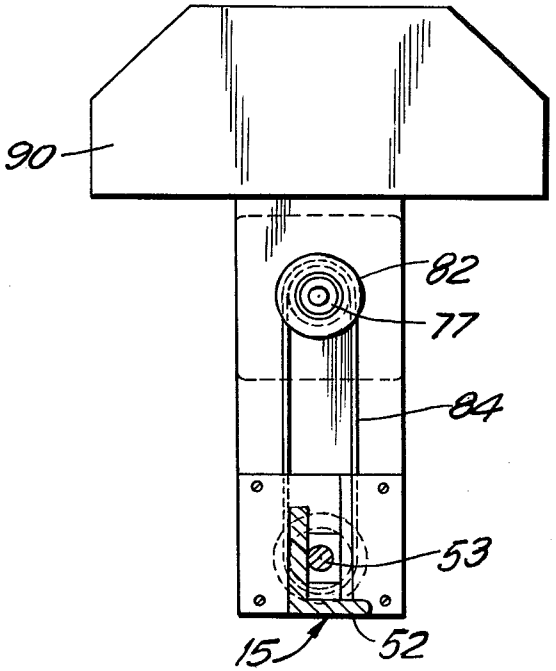
FIG. 6 is a cross-sectional view taken along the section 6—6 of FIG. 5 looking in the direction of the arrow.
Figure 5:
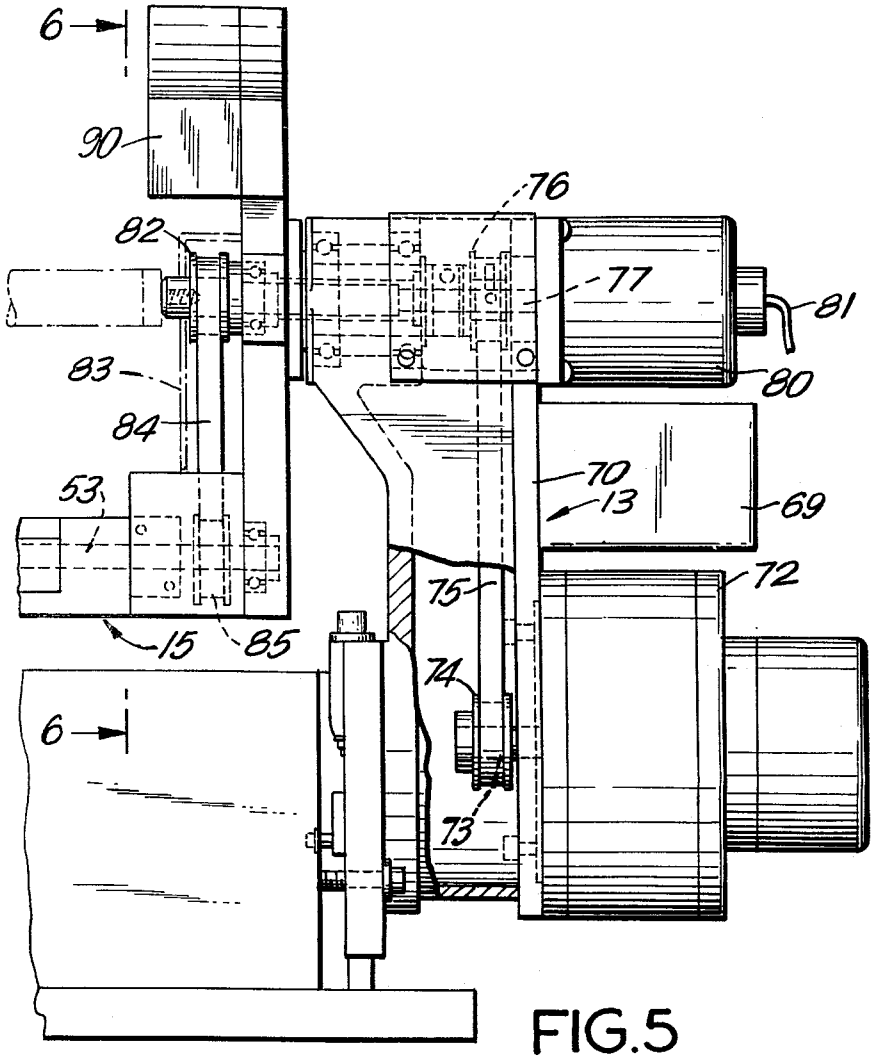
FIG. 5 is a front plan view of a portion of the cradle assembly with a portion of the base being shown in sectional view.

The cradle assembly is shown in FIGS. 5 and 6. The cradle assembly 15 includes support housing 70 which is fixed to the base of the machine and are vertically aligned. A tool holder drive motor 72 is fixed near the bottom of the housing 70 and has a rotatable output shaft 73 to which a first pulley 74 is secured. The pulley 74 rotates the timing belt 75 which drives a second pulley 76. An encoder 80 is fixed near the top of the housing 70 and provides an electrical signal to the lead 81. The electrical signal corresponds to the rotary position of the shaft 77 and therefore to the position of the tool holder. A third pulley 82, within the cradle arm housing 83, is secured to shaft 77 and turns a second timing belt 84. The second timing belt 84 rotates a fourth pulley 85 which is secured to the worm gear shaft 53. A control box housing 69, fastened to the housing 70, contains a spindle, sensors and end switches to govern the rotary motion of the worm 55 and worm gear 56.

The cradle arm housing 83 is secured to the counterweight 90.

In operation, the motor 72, which is preferably a two-way (clockwise and counterclockwise) step (pulse) motor, rotates its shaft 73, and the pulley 74 connected thereto, to turn the timing belt 75. The timing belt acts upon the pulley 76, which is secured to the shaft 77 and turns the pulley 78. The pulley 78 turns the second timing belt 84 which turns the pulley 85.

The exact rotary position of the shaft 77, and therefore the tool holder, is fed back to the controlling computer from the encoder 80. The number of steps (pulses) fed to the step drive motor 72 depends upon the desired position of the tool holder and also the rotary position of the cradle. As the cradle is swung there occurs a change in position as between the pulley 82 and pulley 85, which is taken account of, by the controlling computer system, in feeding the pulses to the drive motor 72.

Figure 7:
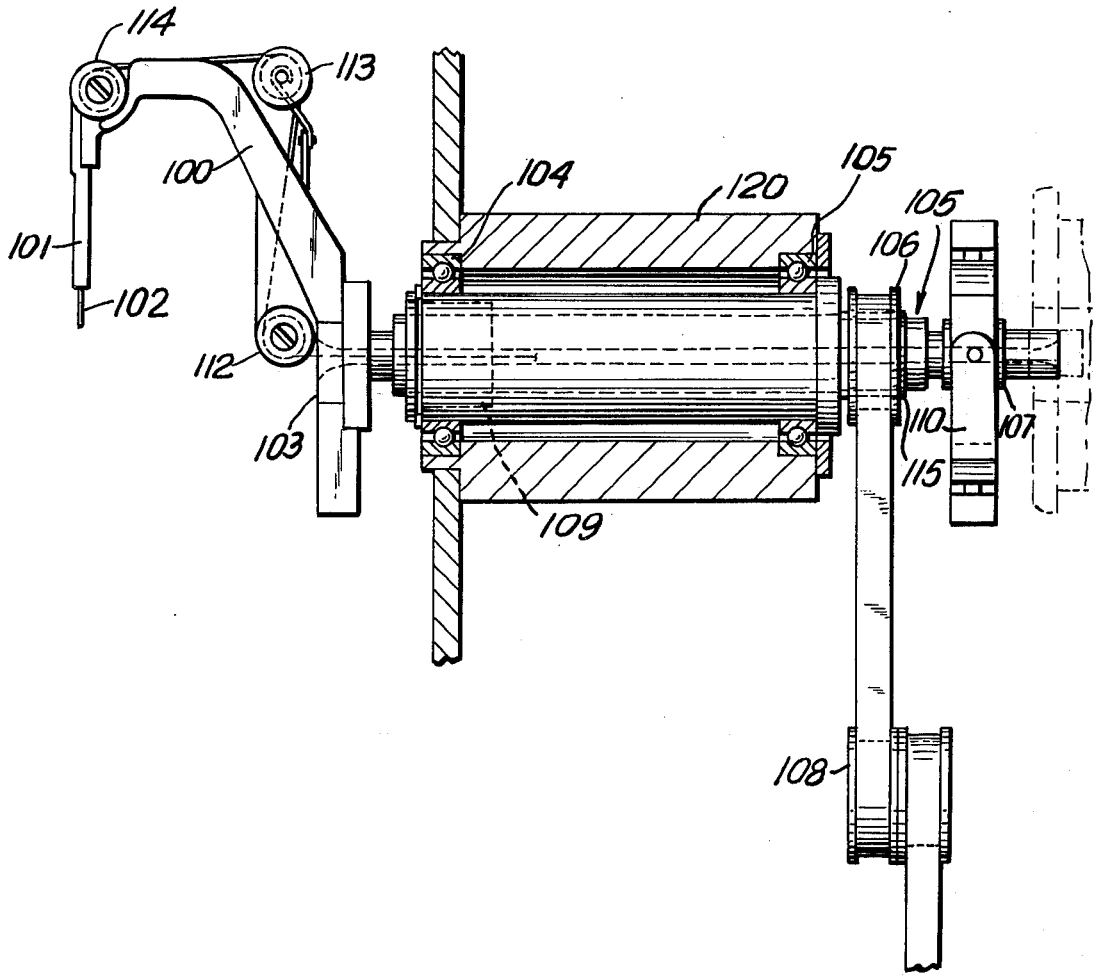
FIG. 7 is a side view, partly in section, of the flyer arm assembly.

The flyer arm (winding arm) assembly is shown in FIG. 7. The flyer arm 100 has a tubular (hollow) nozzle 101 through which the wire 102 is pulled. The flyer arm 100 is fixed to a tubular shaft 103 through which the wire 102 is progressed. The wire comes out of the end of the shaft 103 and over pulleys 112,113 and 114 which are rotatably mounted on the flyer arm.

The shaft 103 is freely rotatable in bushings 104,105 and also may slide in the direction of its imaginary central axis, within the bushings 104,105. The bushings 104,105 are held in flyer arm assembly housing 120 which is fixed to the back of the base of the machine.

The outer wall of the tubular shaft 103 is smooth, i.e., round in cross-section, in the bushings 104,105 and as far as the shaft 103 may slide within those bushings. However, in an area between the two bushings 104,105 the tubular shaft 103 is splined, i.e., evenly grooved, at its outer wall within splines parallel to its axis. The splines in the shaft 103 match the grooves in the drive pulley 106. The drive pulley is rotatably mounted on the outer wall of the bushing 115 and does not move axially. The shaft may slide along its axis within the pulley 106 and, regardless of its axial position, is rotated along with the pulley 106.

The pulley 106 is rotated by a timing belt which is turned by the bottom driven pulley 108. The pulley 108 is driven from a shaft and a separate motor (not shown) or may be driven by a gear system (not shown). The mechanism of the flyer arm assembly is the same for both flyer arms.

A bushing 107 is mounted in the arms of a "U" shaped bracket 110. The bracket 110 is mounted on two spindles and is driven by gears, forward and backward, along the direction of the axis of the tubular shaft 103 in order to move the tubular shaft forward and backwards along its axis. Such movement causes the flyer arm 100 to move relative to the core, the speed of such movement being determined by the step motor. Preferably a two-way pulse motor (not shown) is used to move the bracket 110 and consequently its speed need not be uniform. Alternatively, the bracket 110 may be mounted on one end of a cross-bar which carries, at its other end, another similar bracket. The cross-bar may be moved back and forth by being secured to a two-way nut which moves on a two-way threaded shaft which is constantly rotated in one direction. The nut, and the cross-bar secured thereto, moves axially in one direction until a stop and then reverses and moves in the opposite direction.

Figure 8:
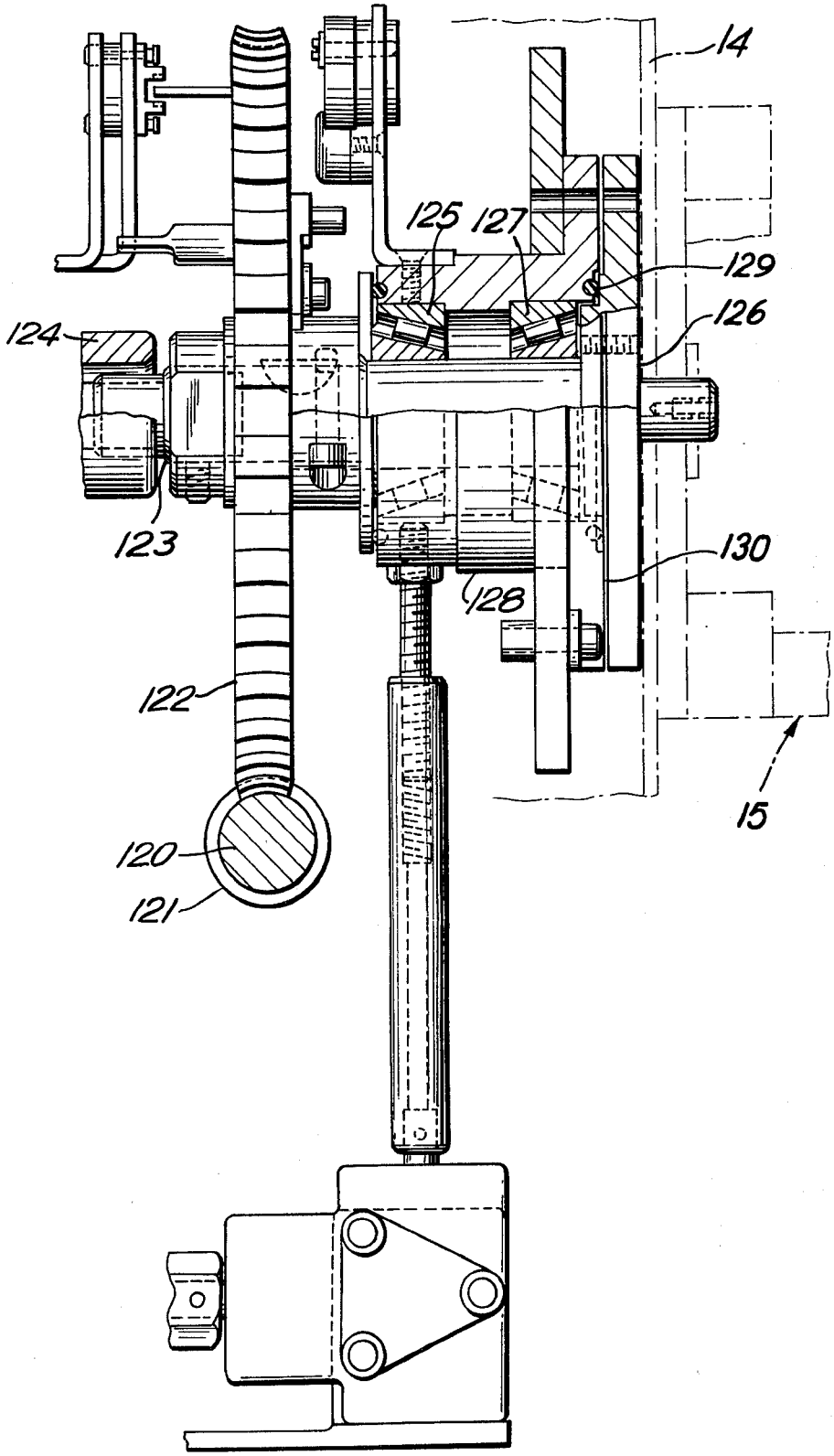
FIG. 8 is a front view, partly in section, of the drive mechanism which rocks the cradle assembly.

The drive mechanism which rocks (swings back and forth) the cradle assembly 15 is shown in FIG. 8. A shaft 120 having a worm gear 121 fixed thereto is rotatably driven by a motor (not shown) which is fixed to the base. Preferably the motor is a pulse motor which rotates the shaft both clockwise and counterclockwise under control of the computer control system. The worm 121 meshes with the large worm gear 122 which is fixed to a shaft 123. The shaft 123 is mounted for rotative motion by the bearings 125,127 mounted in the bearing housing 128 portion of the housing. An end of shaft 123 fits into connector 124. The shaft 123 is secured to the plate 126 which, in turn, is fastened to the cradle arm so that the shaft 123 moves the cradle arm. The plate 126 rotates relative to the face 130 of the bearing housing 128. A nylon ring seal 129, between plate 126 and face 130, prevents dirt from entering the shaft space and permits the plate 126 to rotate. The rotational motion of the shaft 123 rotates the cradle assembly 15. When the worm 121 is rotated clockwise the cradle assembly will rock (swing) in one direction and when the worm 121 is rotated counterclockwise the cradle assembly will rock (swing) in the opposite direction. Consequently, the speed, direction and extent of rocking motion of the cradle arm is under direct control of the pulse motor which rotates the shaft 120.

What is claimed is:

1. A coil winding machine for winding wire on a core to form a coil, the coil winding machine comprising, mounted on a base:

a flyer arm means which is revolvable about an imaginary axis and carries the wire to wind it upon said core;

means to rotate said flyer arm about said axis;

means to reciprocatively move said flyer arm means back and forth along said axis;

clamp means to removably hold said core while it is being wound;

arbor means connected to said clamp means;

means to rock said arbor means back and forth about an axis to vary the position of said core relative to said flyer arm;

cradle means carrying said arbor means and pivotally mounted on said base; and means to rock said cradle means back and forth about its pivot mount.

2. A coil winding machine as in claim 1 wherein said flyer arm means comprises a flyer arm, a series of wire pulleys freely rotatably mounted on said flyer arm, a tubular shaft connected to said flyer arm through which said wire is pulled and having an exterior wall having round portions partly along its length and having a splined portion partly along its length, bushings mounted on said base and rotatably holding said round portions and a splined pulley in driving contact with said splined portion.

3. A coil winding machine as in claim 1 wherein said arbor means includes a worm gear fixed thereon and said means to rock said arbor means includes a worm rotatably mounted in said cradle means, said worm meshing with and driving said worm gear.

4. A coil winding machine for winding wire on a core to form a coil, the coil winding machine comprising, mounted on a base:

a flyer arm means which is revolvable about its imaginary axis and carries the wire to wind it upon said core;

means to rotate said flyer arm means about its axis;

clamp means to removably hold said core while it is being wound;

arbor means connected to said clamp means and including a worm gear fixed thereon;

cradle means carrying said arbor means and pivotally mounted on said base;

worm gear drive means to rock said arbor means back and forth about an axis, including a worm rotatably mounted in said cradle to vary the position of said core relative to said flyer arm; and means to rock said cradle means back and forth about its pivot mount.

5. A coil winding machine as in claim 4 wherein said flyer arm means comprises a flyer arm, a series of wire pulleys freely rotatably mounted on said flyer arm to guide said wire, a tubular shaft connected to said flyer arm through which said wire is pulled and having an exterior wall which is round partly along its length and splined partly along its length, bushings mounted on said base and rotatably holding said round portions and a splined pulley in driving contact with said splined portion.

6. A coil winding machine for winding wire on a core to form a coil, the coil winding machine comprising, mounted on a base:

a flyer arm means which is revolvable about its imaginary axis and carries the wire to wind it upon said core;

means to rotate said flyer arm about its axis, said flyer arm means comprising a flyer arm, a series of wire pulleys freely rotatably mounted on said flyer arm, a tubular shaft connected to said flyer arm through which said wire is pulled and having an exterior wall which is round partly along its length and splined partly along its length, bushings mounted on said base and rotatably holding said round portions and a splined pulley in driving contact with said splined portion;

means to reciprocatively move said flyer arm means back and forth along its axis;

clamp means to removably hold said core while it is being wound;

arbor means connected to said clamp means and including a worm gear fixed thereon;

cradle means carrying said arbor means and pivotally mounted on said core;

means to rock said arbor means back and forth about an axis to vary the position of said core relative to said flyer arm, including a worm rotatably mounted in said cradle means, said worm meshing with and driving said worm gear; and means to rock said cradle means back and forth about its pivot mount.

* * * * *